US007687730B2

(12) United States Patent
Mihara

(10) Patent No.: US 7,687,730 B2
(45) Date of Patent: Mar. 30, 2010

(54) OPERATING SWITCH UNIT FOR USE IN AUTOMOTIVE VEHICLE

(75) Inventor: Kenjiro Mihara, Obu (JP)

(73) Assignee: Denso Corporation, Kariya (JP)

( * ) Notice: Subject to any disclaimer, the term of this patent is extended or adjusted under 35 U.S.C. 154(b) by 896 days.

(21) Appl. No.: 11/504,880

(22) Filed: Aug. 16, 2006

(65) Prior Publication Data

US 2007/0144877 A1 Jun. 28, 2007

(30) Foreign Application Priority Data

Aug. 31, 2005 (JP) ..... 2005-251969

(51) Int. Cl.
*H01H 9/00* (2006.01)

(52) U.S. Cl. ..... 200/310; 200/314

(58) Field of Classification Search ..... 200/310, 200/314

See application file for complete search history.

(56) References Cited

U.S. PATENT DOCUMENTS 5,581,251 A * 12/1996 McRight et al. ..... 341/22
5,711,588 A * 1/1998 Rudisill ..... 362/30
6,928,297 B2 * 8/2005 Kitamura et al. ..... 455/550.1
7,253,369 B2 * 8/2007 Fu et al. ..... 200/310
2007/0144877 A1 * 6/2007 Mihara ..... 200/47
2009/0107816 A1 * 4/2009 Chen et al. ..... 200/314

FOREIGN PATENT DOCUMENTS

JP 2000-251561 9/2000

* cited by examiner

*Primary Examiner*—Renee S Luebke
*Assistant Examiner*—Vanessa Girardi
(74) *Attorney, Agent, or Firm*—Harness, Dickey & Pierce, PLC

(57) ABSTRACT

A switch panel including a switch unit is mounted on a dashboard of an automotive vehicle. The switch unit has switches for operating devices mounted on the vehicle and ornamental members disposed between the switches. The ornamental member is composed of a base portion and a portion extending from the base portion. Front surfaces of the extending portion and the base portion are covered with an ornamental light-reflecting layer. The front surface of the extending portion is positioned flush with a touch surface of the switch. The front surface of the base portion is sloped so that light incident thereon is reflected toward a direction not in parallel to a gap formed between the extending portion and the switch. The light reflected on the sloped surface is invisible while the front surface of the extending portion is clearly visible, enhancing ornamental design effects of the switch unit.

11 Claims, 10 Drawing Sheets

OPERATING SWITCH UNIT FOR USE IN AUTOMOTIVE VEHICLE

CROSS-REFERENCE TO RELATED APPLICATION

This application is based upon and claims benefit of priority of Japanese Patent Application No. 2005-251969 filed on Aug. 31, 2005, the content of which is incorporated herein by reference.

BACKGROUND OF THE INVENTION

1. Field of the Invention

The present invention relates to a switch unit for operating electric or electronic devices mounted on an automotive vehicle.

2. Description of Related Art

A switch unit for operating devices mounted on an automotive vehicle, such as an air-conditioning device, an audio device and a car navigation system, is installed or provided in a compartment of a vehicle. An ornamental member having a light-reflecting surface is often used on a front surface of the switch unit to enhance an ornamental design. Such an ornamental member is installed at a desired position of the switch unit after it is manufactured separately from the switch unit. The ornamental member is often formed as a single body all covered with an ornamental light-reflecting layer.

The ornamental member is positioned close to a neighboring member such as a movable switch or a front panel. It is preferable to prevent light reflected on portions of the light-reflecting surface that do not contribute to ornamental design effects from reaching eyes of a driver or a passenger. However, it is difficult to intercept such reflected light because the light comes out through a gap between the ornamental member and the neighboring member. To prevent or suppress such reflected light, some techniques are known. For example: (1) making a rough surface underneath the light-reflecting layer, as disclosed in JP-A-2000-251561; (2) forming a layer for preventing light reflection on certain portion of the light-reflecting layer; and (3) preventing formation of the light-reflecting layer on portions where the light-reflecting layer is not desired to be formed.

However, the technique (1) is not sufficiently effective because the rough surface formed underneath the light-reflecting layer is smoothened by forming the light-reflecting layer thereon. The technique (2) requires an additional process for forming the preventing layer. In addition, portions on which the preventing layer is not to be formed have to be masked. Similarly, in technique (3), it is necessary to mask the portions on which formation of the light-reflecting layer is not desired, requiring an additional process.

SUMMARY OF THE INVENTION

The present invention has been made in view of the above-mentioned problem, and an object of the present invention is to provide an improved switch unit having an ornamental member, in which the undesired light reflected on portions of the ornamental member is sufficiently suppressed.

A switch panel including a liquid crystal display panel and a switch unit is mounted on a dashboard of an automotive vehicle. The switch unit includes plural switches for operating devices mounted on the vehicle such as an air-conditioner and ornamental members disposed between the switches. The ornamental member is composed of a base portion and an extending portion standing up from the base portion. The extending portion has a rectangular cross-section having a long side and a short side. A front surface of the extending portion, which is positioned flush with a touch surface of the switch, and a front surface of the base portion are covered with an ornamental light-reflecting layer.

By positioning the front surface of the extending portion between two switches, a first gap is formed between the extending portion and switch along the long side of the extending portion, and a second gap is formed along the short side of the extending portion. A first sloped surface is formed on the front surface of the base portion at a position facing the first gap, and the second sloped surface is formed at a position facing the second gap. The first sloped surface is formed at both sides of the extending portion along its long side, while the second sloped surface is formed at both longitudinal ends of the extending portion. Both of the sloped surfaces decline from the foot portion of the extending portion toward the outer fringe of the base portion.

Light incident upon the sloped surfaces through the gaps is reflected thereon toward a direction which is not parallel to the gaps. Therefore, the reflected light does not come out from the gaps and does not directly reach eyes of a user. This means that the front surface of the extending portion is bright while the gaps are dark. Therefore, the switches are clearly separated from one another by the front surface of the extending portion. Thus, ornamental effects of the switch unit are enhanced. In addition, errors in selecting switches to be operated are minimized because each switch is clearly separated from one another by the ornamental member.

As long as the light is reflected on the front surface of the base portion so that the user is not disturbed by the reflected light, slopes on the front surface may be variously modified. Other objects and features of the present invention will become more readily apparent from a better understanding of the preferred embodiments described below with reference to the following drawings.

DETAILED DESCRIPTION OF THE PREFERRED EMBODIMENTS

Figure 1:
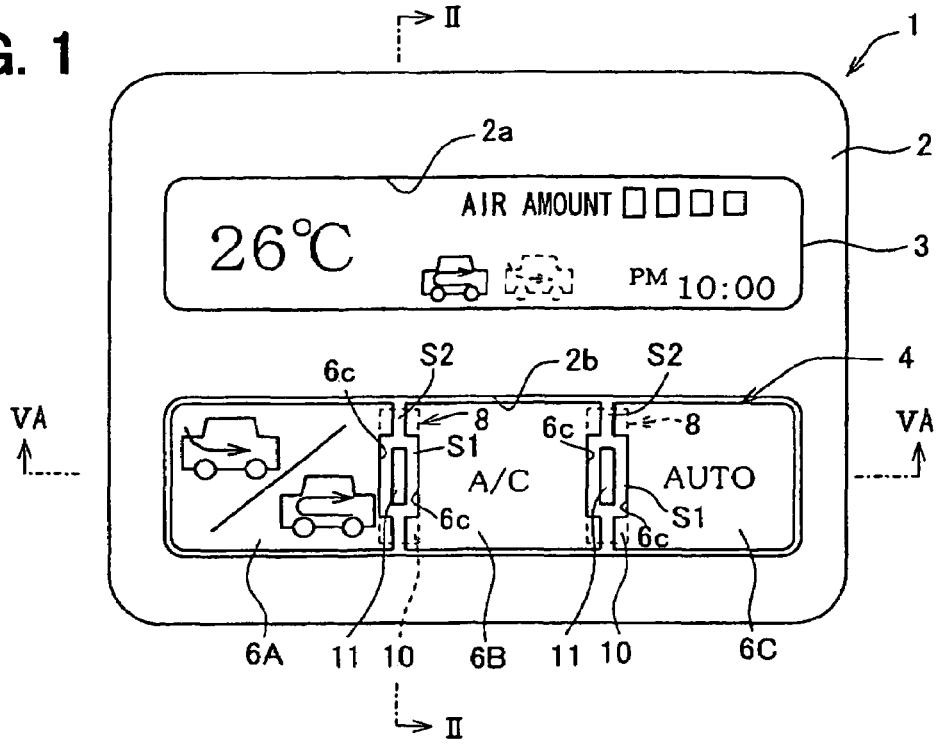
FIG. 1 is a front view showing a switch unit for use in an automotive vehicle, as a first embodiment of the present invention.

A first embodiment of the present invention will be described with reference to FIGS. 1-12. FIG. 1 shows a switch unit 1 for operating an air-conditioner mounted on an automotive vehicle. The switch panel 1 is contained in a casing 2. The switch panel 1 includes a liquid crystal display panel (LCD) 3 and a switch unit 4. The LCD panel 3 is exposed to outside from a window 2*a* of the switch panel 1, and the switch unit 4 is installed in a window 2*b* of the switch panel 1.

The switch unit 4 includes three switches 6 (6A, 6B and 6C) and two ornamental members 8 disposed between switches 6. The switch 6A is a switch for switching between outside air and inside air. The switch 6B is a switch for turning on and off the air-conditioner. The switch 6C is a switch for switching between an automatic operation and a manual operation. By pushing these switches, operation of the air-conditioner is controlled by a user (a passenger or a driver). On the LCD panel 3, temperature in the passenger compartment, whether outside air is introduced or not, an amount of air supplied to the passenger compartment and present time are displayed.

Figure 2:
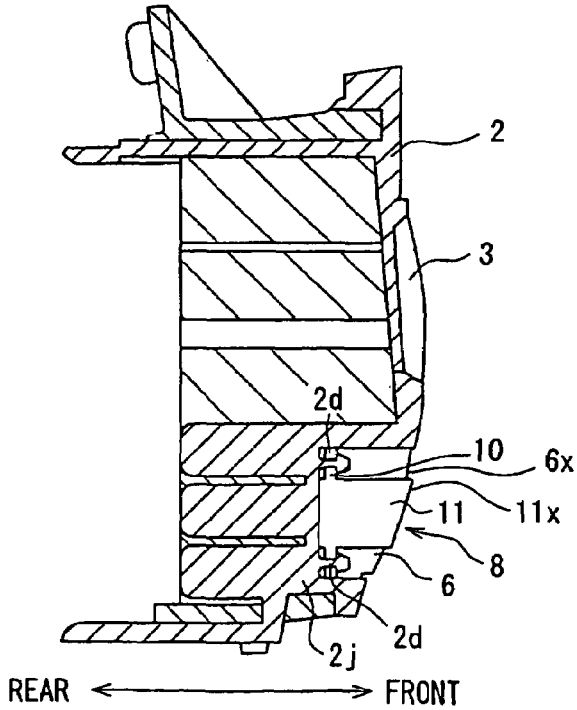
FIG. 2 is a cross-sectional view showing the switch unit, taken along line II-II in FIG. 1.
Figure 3:
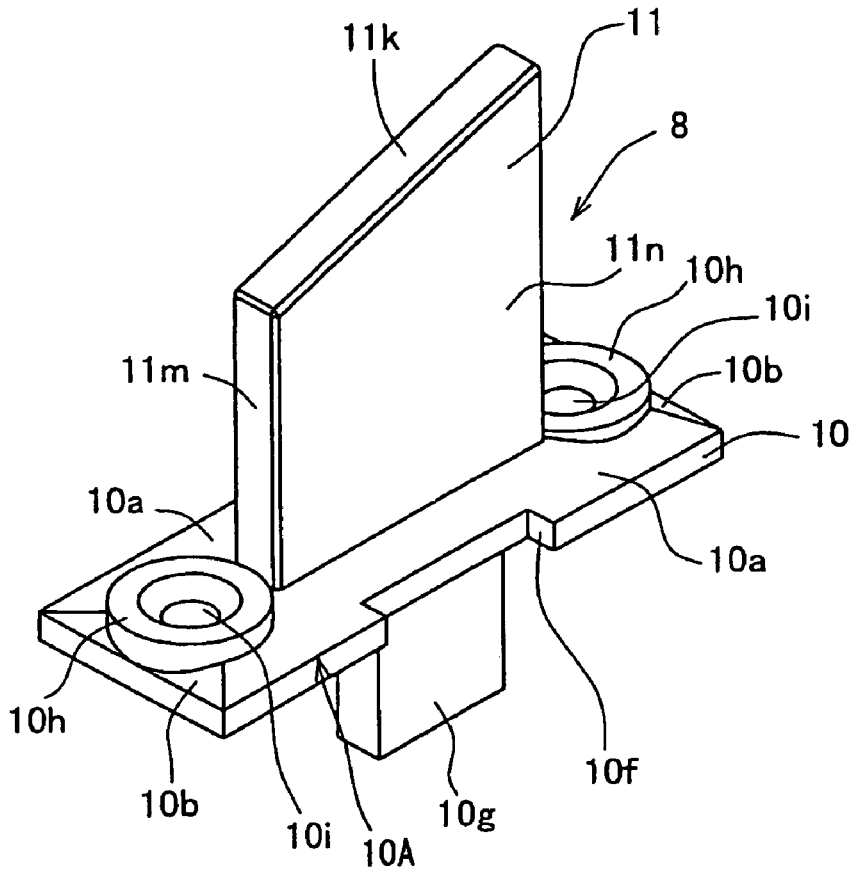
FIG. 3 is a perspective view showing an ornamental member used in the switch unit.

The ornamental member 8 shown in FIG. 3 is installed in the switch unit 4 as shown in FIGS. 1 and 2. As shown in FIG. 3, the ornamental member 8 is composed of a base portion 10 and an extending portion 11 standing up from the base portion 10. The extending portion 11 extends from the base portion 10 in a direction perpendicular to a front surface 10A of the base portion 10. The extending portion 11 is plate-shaped and has a front surface 11*k*, end surfaces 11*m* and side surfaces 11*n*. The front surface 11*k* is exposed to the front of the switch unit 4 and is positioned substantially flush with a touch surface (front surface) of the switches 6. The ornamental member 8 is disposed between switches 6 as shown in FIGS. 5A and 5B.

Figure 5A:
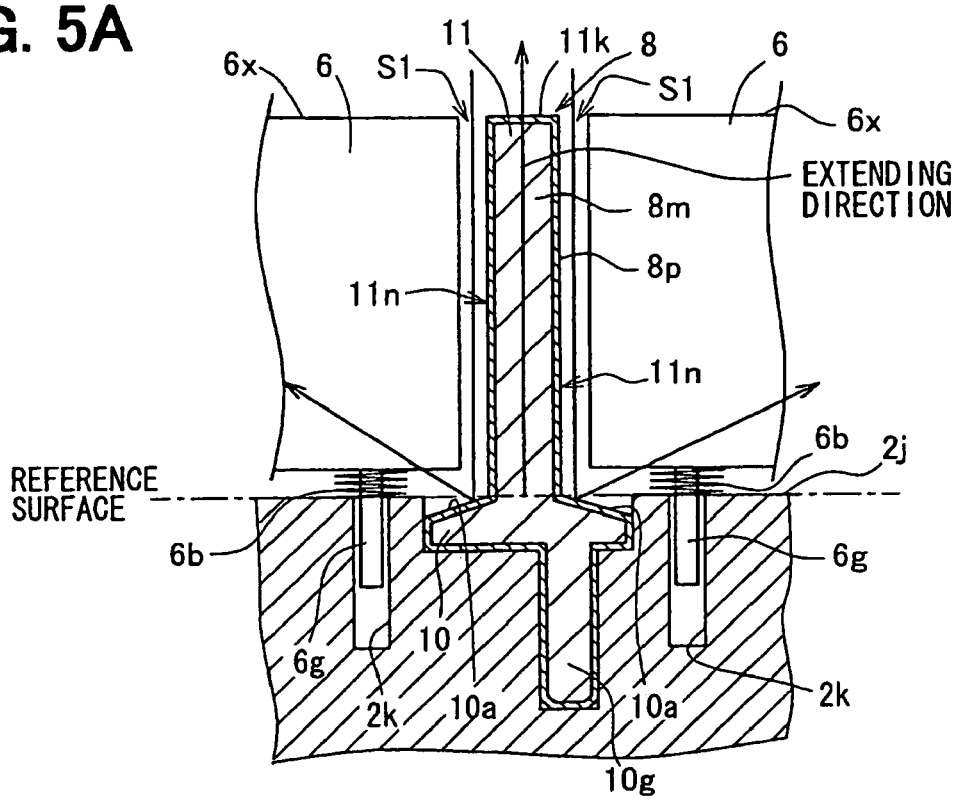
FIG. 5A is a cross-sectional view showing an essential portion of the switch unit for explaining the present invention, taken along line VA-VA in FIG. 1.

The front surface 11*k*, end surfaces 11*m*, side surfaces 11*n* and the front surface 10A of the base portion 10 are covered with an ornamental light-reflecting layer 8*p* (refer to FIG. 5A). The ornamental light-reflecting layer 8*p* is integrally formed on a molded body 8*m* (refer to FIG. 5A). The ornamental light-reflecting layer 8*p* is a metallic layer formed by plating. More particularly, the surface of the molded body 8*m* is activated, and then a copper layer is formed on the surface by electroless plating, and an ornamental chrome layer covering the copper layer is formed. The ornamental chrome layer may be formed by either electroless plating or by electrolytic plating using a barrel plating process. Alternatively, the ornamental light-reflecting layer 8*p* may be made by processes other than metallic plating, such as aluminum vapor deposition, sputtering or by metallic layer painting.

Figure 5B:
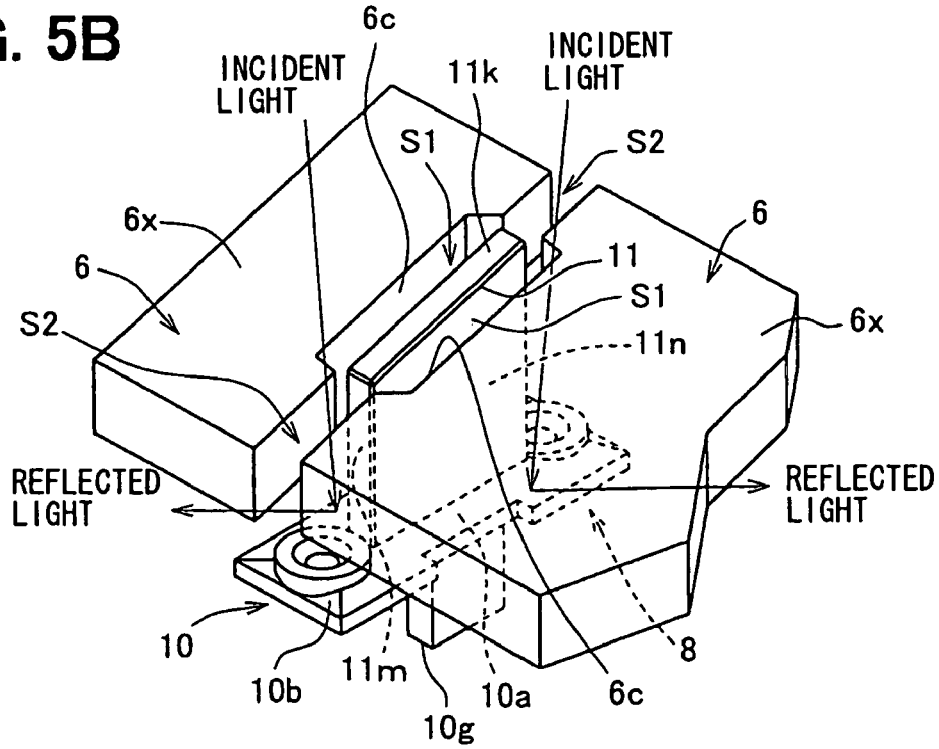
FIG. 5B is a perspective view showing an essential portion of the switch unit for explaining the present invention.

As shown in FIGS. 1, 5A and 5B, the switch 6 (constituting a member neighboring the ornamental member 8) includes a depression 6*c* that forms a first gap S1 between the extending portion 11 of the ornamental member 8 and the switch 6. As better seen in FIG. 5B, second gaps S2 are formed at both longitudinal ends of the extending portion 11. In other words, the front surface 11*k* of the extending portion is surrounded by pairs of the first gaps S1 and the second gaps S2. The front surface 10A of the base portion 10 has a pair of first sloped surfaces 10*a* and a pair of second sloped surfaces 10*b* as shown in FIG. 3. The first sloped surface 10*a* faces the first gap S1 while the second sloped surface 10*b* faces the second gap S1. The first sloped surfaces 10*a* and the second sloped surfaces 10*b* are declined from a foot portion of the extending portion 11 toward a fringe of the base portion 10.

Figure 17:
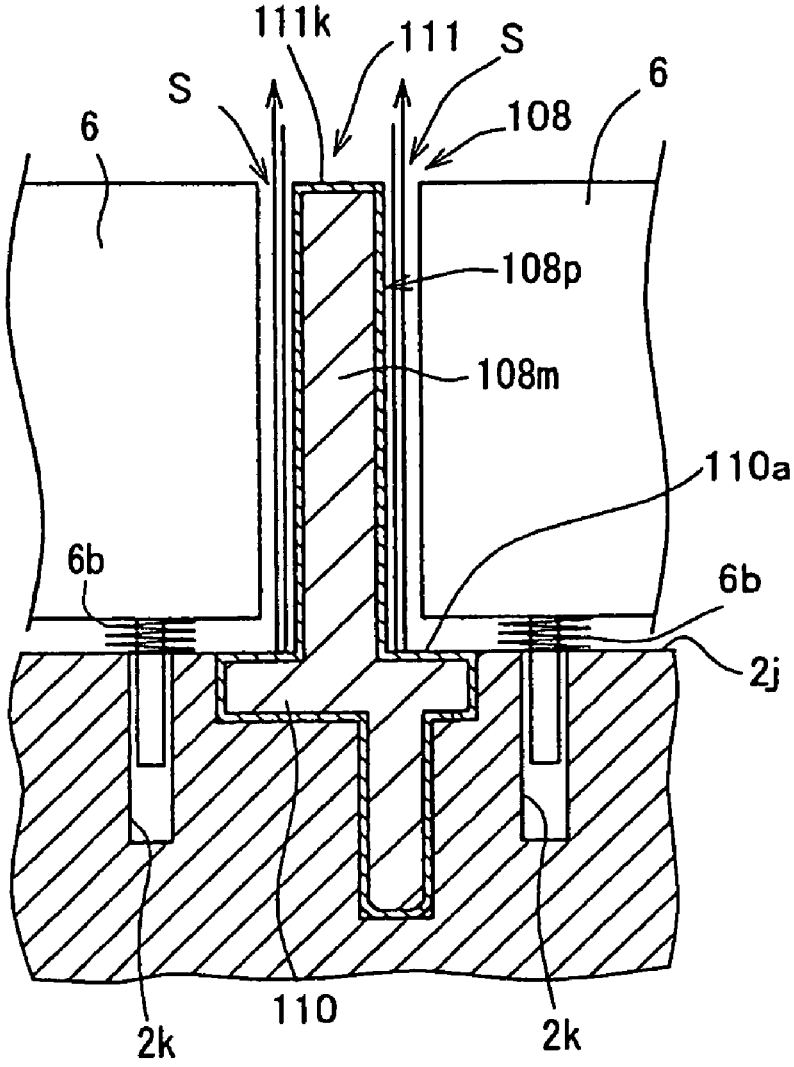
FIG. 17 PRIOR ART
FIG. 17 is a prior art ornamental member disclosed between two switches.

FIG. 17 shows an example of a conventional ornamental member 108 disposed between switches 6. The ornamental member 108 is composed of a base portion 110 and an extending portion 111. A surface of a molded body 108*m* is covered with an ornamental light-reflecting layer 108*p*. A front surface 110*a* of the base portion 110 is flat (not declined). Light reflected on the flat front surface 110*a* is directed straight through a gap S between the extending portion 111 and the switches 6, as shown in FIG. 17. Therefore, the light reflected on the front surface 11*a* is visible from outside in addition to light reflected on the front surface 111*k* of the extending portion 111. Thus, the ornamental design is adversely affected. A guiding stud of the switch 6 is slidably supported in a guiding hole 2*k*, and the switch 6 is biased upward by a return spring 6*b*.

As opposed to the conventional ornamental member, the front surface 10A of the ornamental member 8 of the present invention is sloped, forming the first sloped surfaces 10*a* and the second sloped surfaces 10*b*. Therefore, as shown in FIG. 5A, light incident upon the sloped surfaces 10*a*, 10*b* through the first and the second gaps S1, S2 is reflected on the sloped surfaces 10*a*, 10*b* toward a direction different from the direction of the gaps S1, S2. Accordingly, the light reflected on the sloped surfaces 10*a*, 10*b* is not visible from outside. The declining angle of the sloped surfaces is so set that the reflected light does not escape through the gaps S1, S2, or the reflected light is not visible from a user even if part of the reflected light escapes through the gaps S1, S2. Most of the light reflected on the sloped surfaces 10*a*, 10*b* is directed to walls of the switches and scattered there. Thus, unnecessary reflected light that damages ornamental effects is eliminated or sufficiently suppressed.

Figure 4A:
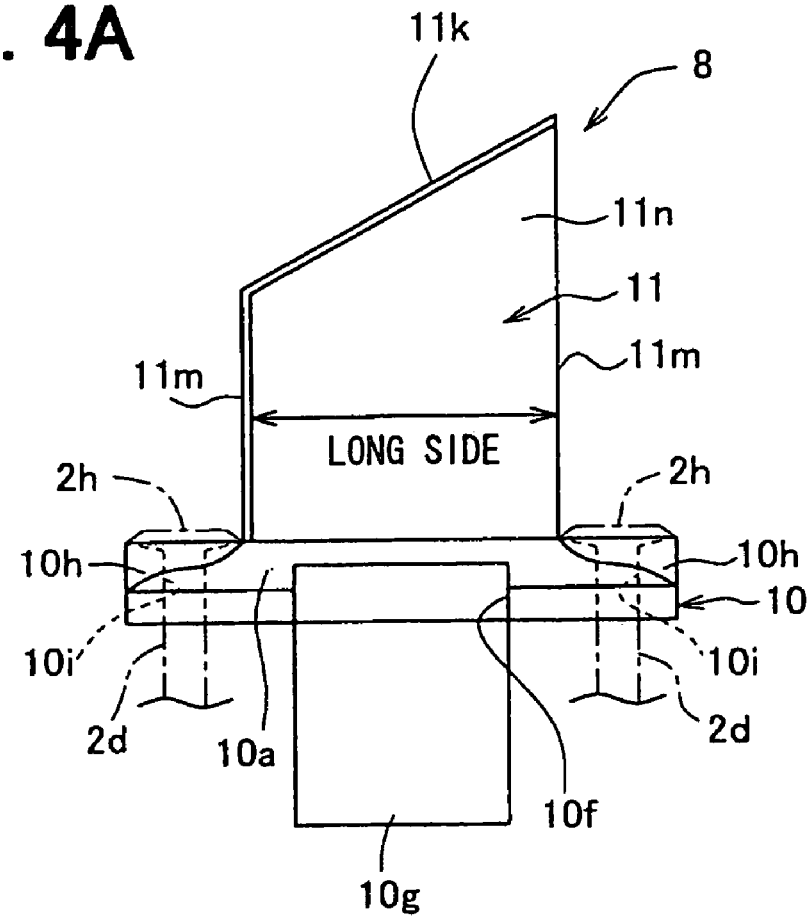
FIG. 4A is a side view showing the ornamental member.

As shown in FIGS. 1 and 2, touch surfaces 6*x* of the switches 6 are separated by the extending portion 11 of the ornamental member 8. The front surface 11*k* of the extending portion 11 is covered with the ornamental light-reflecting layer 8*p*, and the gaps S1, S2 surrounding the front surface 11*k* are substantially dark because no reflected light comes out through the gaps S1, S2. Therefore, the respective switches 6A, 6B and 6C are clearly separated from one another, enhancing ornamental effects. Since the switches 6 are clearly visible, not only design effects are enhanced but also driving safety is improved because erroneous selection of the switches is avoided. The front surface 11*k* of the extending portion 11 is sloped as shown in FIG. 4A, so that the front surface 11*k* matches with the sloped front surface of the switch panel 1 as shown in FIG. 2.

Figure 4B:
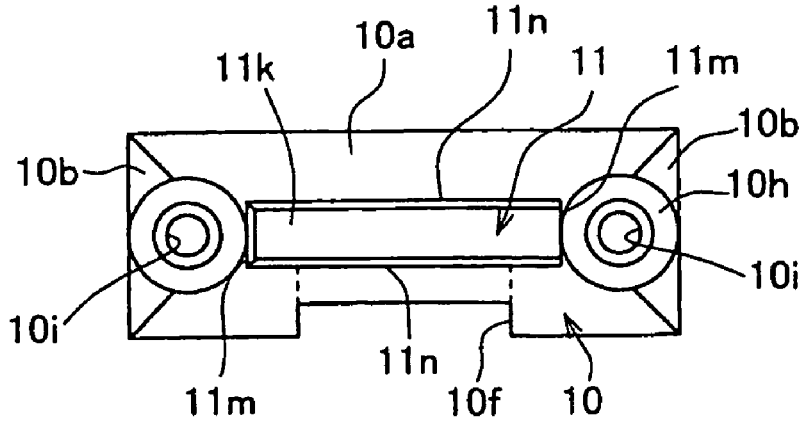
FIG. 4B is a front view showing the ornamental member.

As shown in FIG. 2, a supporting frame 2*j* is integrally formed with the casing 2 by plastic injection molding. As better seen in FIGS. 4A and 4B, a pin 2*d* extending from the supporting frame 2*j* is inserted into a through-hole 10*i* formed in the base portion 10 of the ornamental member 8. A head of the pin 2*d* is heat-staked forming a heat-staked portion 2*h*. The heat-staked portion 2*h* is formed on a receiving dish 10*h* formed on the base portion. Though the receiving dish 10*h* is flat, almost no light is reflected thereon because its flat portion is covered with the heat-staked portion 2*h*. In this manner, the ornamental member 8 is connected to the supporting frame 2*j*. A mounting stud 10*g* is formed underneath the base portion 10, and the ornamental member 8 is correctly positioned in the supporting frame 2*j* by inserting the mounting stud 10*g* in a depression formed in the supporting frame 2*j*. A cutout 10*f* is formed in the base portion 10 as shown in FIG. 4B.

As shown in FIG. 5A, the switch 6 is supported on the supporting frame 2*j* by slidably inserting a guiding stud 6*g* in a guiding hole 2*k* formed in the supporting frame 2*j*. The switch 6 is biased upward by a spring 6*b*, and the switch 6 is pushed down against a biasing force of the spring 6*b*. As better seen in FIG. 5B, the first gap S1 corresponds to the first sloped surface 10*a* which declines from the foot portion of the extending portion 11 toward the fringe of the base portion 10. Light entering through the first gap S1 is reflected on the first sloped surface 10*a* in a direction not parallel to the first gap S1. The second gap S2 is located at the longitudinal end of the first gap S1, as shown in FIG. 5B. Though part of light entering through the second gap S2 is reflected on the first sloped surface 10*a*, some other part of light entering through the second gap S2 is reflected on the second sloped surface 10*b* which declines from the foot portion of the extending portion 11 toward the fringe of the base portion 10.

The following advantages are attained in the embodiment described above. The first gap S1 is formed along the side surface 11*n* of the extending portion 11, and first sloped surfaces 10*a* is formed along the first gap S1. The first sloped surface 10*a* is declined from the foot portion of the extending portion 11 toward the fringe of the base portion. The front surface 11*k* of the extending portion 11 is covered with the ornamental light-reflecting layer 8*p*. Almost no light is visible through the first gap S1 while the front surface 11*k* separating switches 6 is clearly visible. Thus, the ornamental design of the switch unit 4 is enhanced.

Further, the first sloped surface 10*a* is extended in its longitudinal direction beyond the length of the first gap S1, as seen in FIG. 5B. Since light incident upon the extended first sloped surface 10*a* is reflected thereon, the second gap S2 is not visible from a driver even when the switch unit 4 is installed on a center portion of a front dashboard in the direction as shown in FIG. 1. Since the heat-staked portion 2*h* corresponds to the second gap S2, light incident upon the heat-staked portion 2*h* is not directly reflected thereon. This means that the second gap S2 is almost invisible when it is seen from a direct front.

The second sloped surface 10*b* declining from the foot portion of the extending portion 11 toward the fringe of the base portion 10 is formed at a position corresponding to the second gap S2 on the front surface 10A of the base portion 10. Light incident upon the second sloped surface 10*b* is reflected thereon away from it. In particular, when the switch unit 4 is positioned on the front dashboard as shown in FIG. 1, the light is reflected on the upper second sloped surface 10*b* in the upper direction away from the switch unit 4. Similarly, the light incident upon the lower second sloped surface 10*b* is reflected thereon in the lower direction away from the switch unit 4. Since a human vision field is wider in the horizontal direction than in the vertical direction, the reflected light reaching eyes of a driver or a passenger is effectively suppressed in this manner. It is possible, however, to eliminate the second sloped surface 10*b* by further extending the first sloped surface 10*a* to the fringe of the base portion 10.

Figure 6:
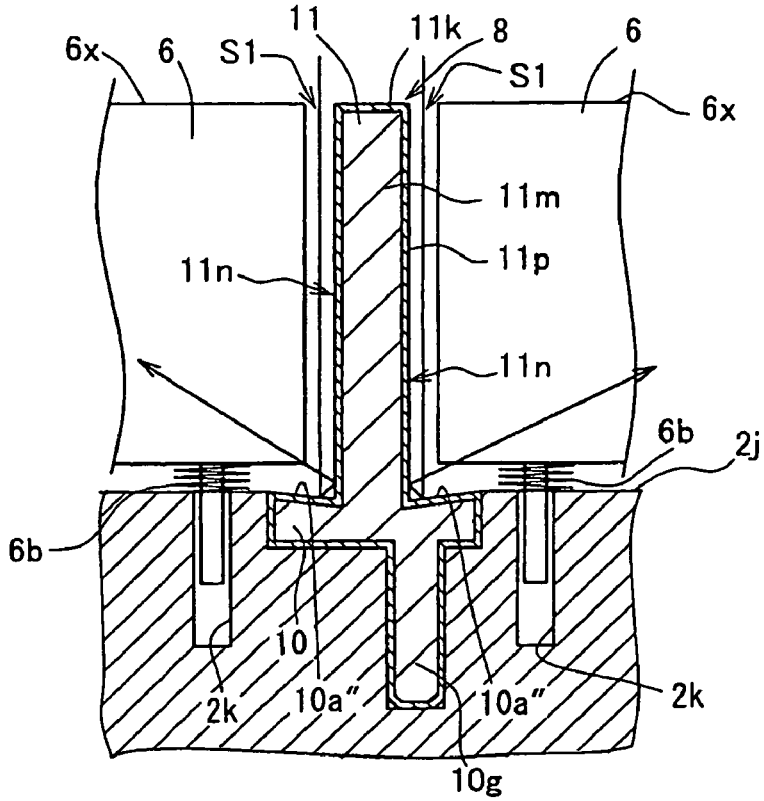
FIG. 6 is a cross-sectional view showing an essential portion of the switch unit as a modified form 1 of the first embodiment.

The first embodiment of the present invention described above may be variously modified. Some of the modified forms will be shown below. FIG. 6 shows modified form 1. In this modified form, the first sloped surface 10*a*" is declined in an opposite direction to that of the first embodiment. Light incident upon the first sloped surface 10*a*" through the first gap S1 is first reflected toward the side surface 11*n* of the extending portion 11 and then toward the neighboring switch 6. In this manner, the reflected light reaching eyes of users is similarly suppressed. It is also possible to decline the second sloped surface in the opposite direction to that of the first embodiment.

Figure 7:
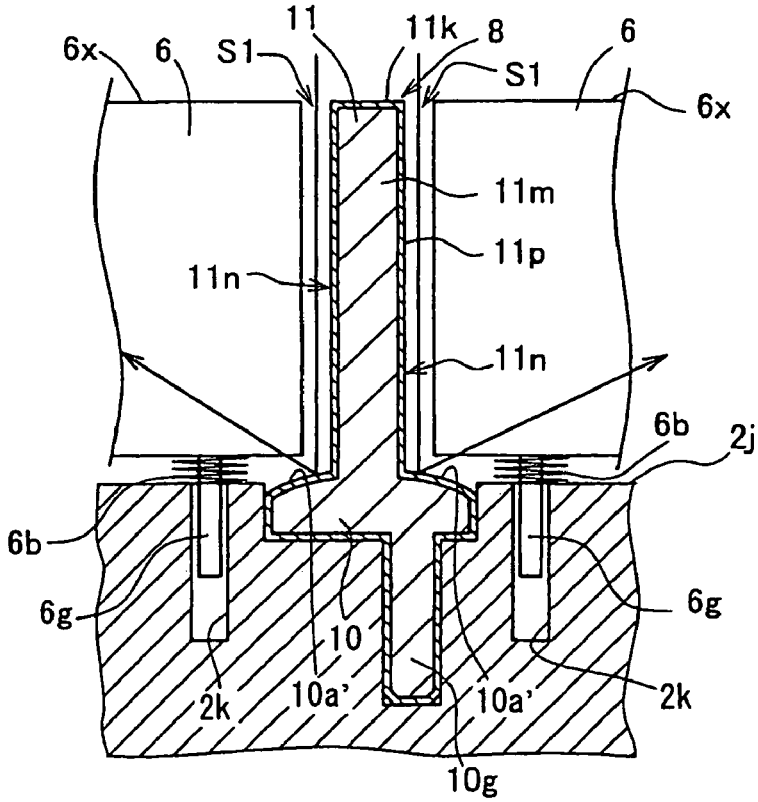
FIG. 7 is a cross-sectional view showing an essential portion of the switch unit as a modified form 2 of the first embodiment.
Figure 8:
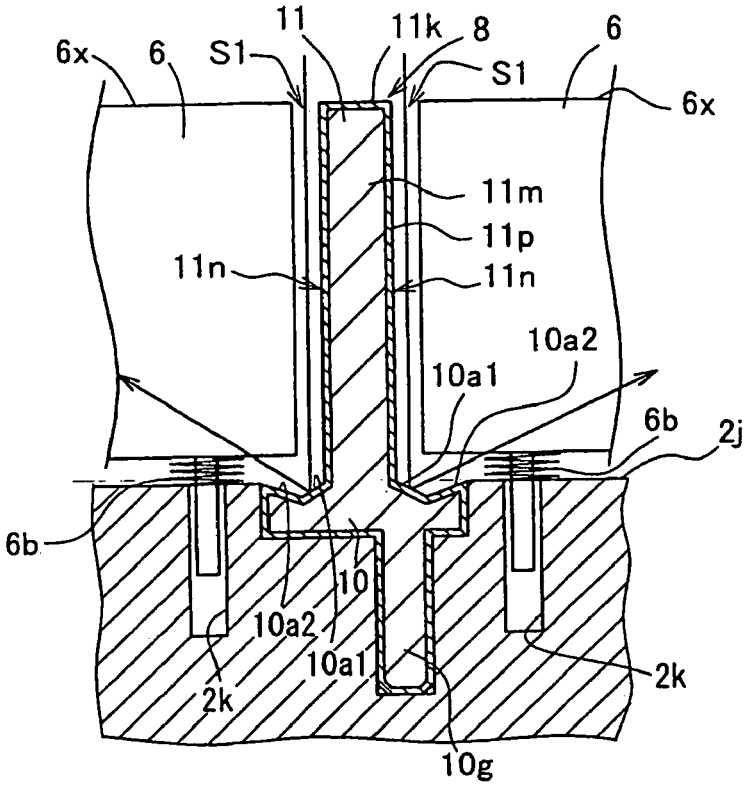
FIG. 8 is a cross-sectional view showing an essential portion of the switch unit as a modified form 3 of the first embodiment.
Figure 9:
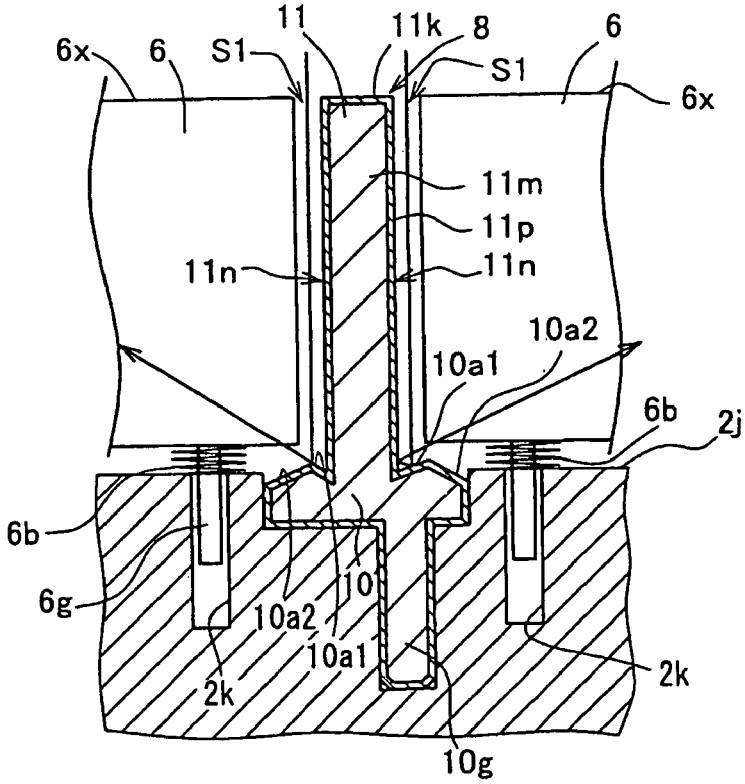
FIG. 9 is a cross-sectional view showing an essential portion of the switch unit as a modified form 4 of the first embodiment invention.

FIG. 7 shows modified form 2. In this modified form, the first sloped surface is modified to a round-curved surface 10*a*'. Modified form 3 is shown in FIG. 8. In this modified form, the first sloped surface is divided into two sloped surfaces 10*a*1 and 10*a*2, both declining in opposite directions to each other. Modified form 4 is shown in FIG. 9, in which the sloped surfaces 10*a*1 and 10*a*2 are declined in directions different from those of the modified form 3. Similar effects are attained in these modified forms, too.

Figure 10:
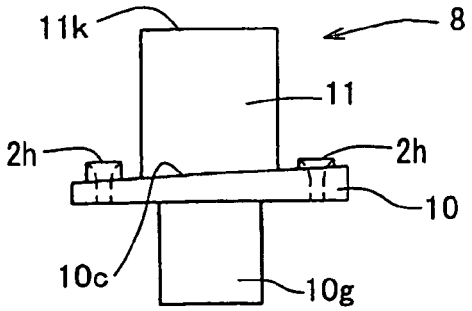
FIG. 10 is a side view showing an ornamental member used in the switch unit, as a modified form 5 of the first embodiment.
Figure 11:
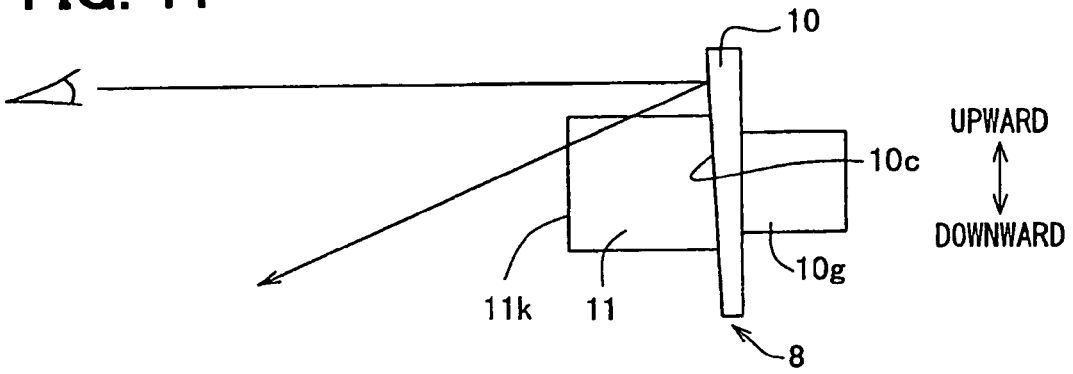
FIG. 11 is a schematic view showing an example of a light path reflected on the ornamental member shown in FIG. 10.
Figure 12:
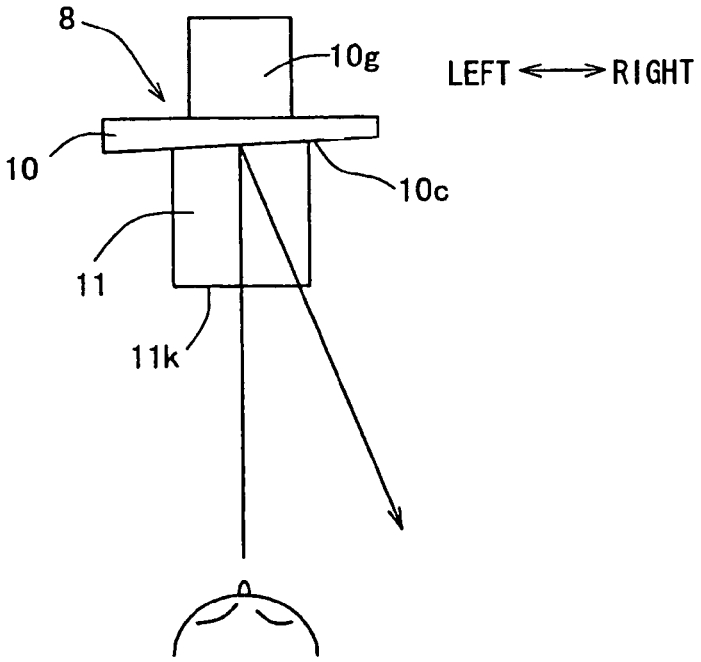
FIG. 12 is a schematic view showing another example of a light path reflected on the ornamental member shown in FIG. 10.

Modified form 5 is shown in FIG. 10, in which the first sloped surface 10*a* and the second sloped surface 10*b* in the first embodiment are combined into one sloped surface 10*c*. When this modified form 5 is positioned as shown in FIG. 1, the light incident upon the sloped surface 10*c* is reflected downward as shown in FIG. 11. In this manner, the reflected light reaching eyes of the user is suppressed. When the modified form 5 is positioned relative to the user as shown in FIG. 12, the light is reflected on the sloped surface 10*c* toward the rightward. The reflected light reaching eyes of the user is similarly suppressed.

Figure 13:
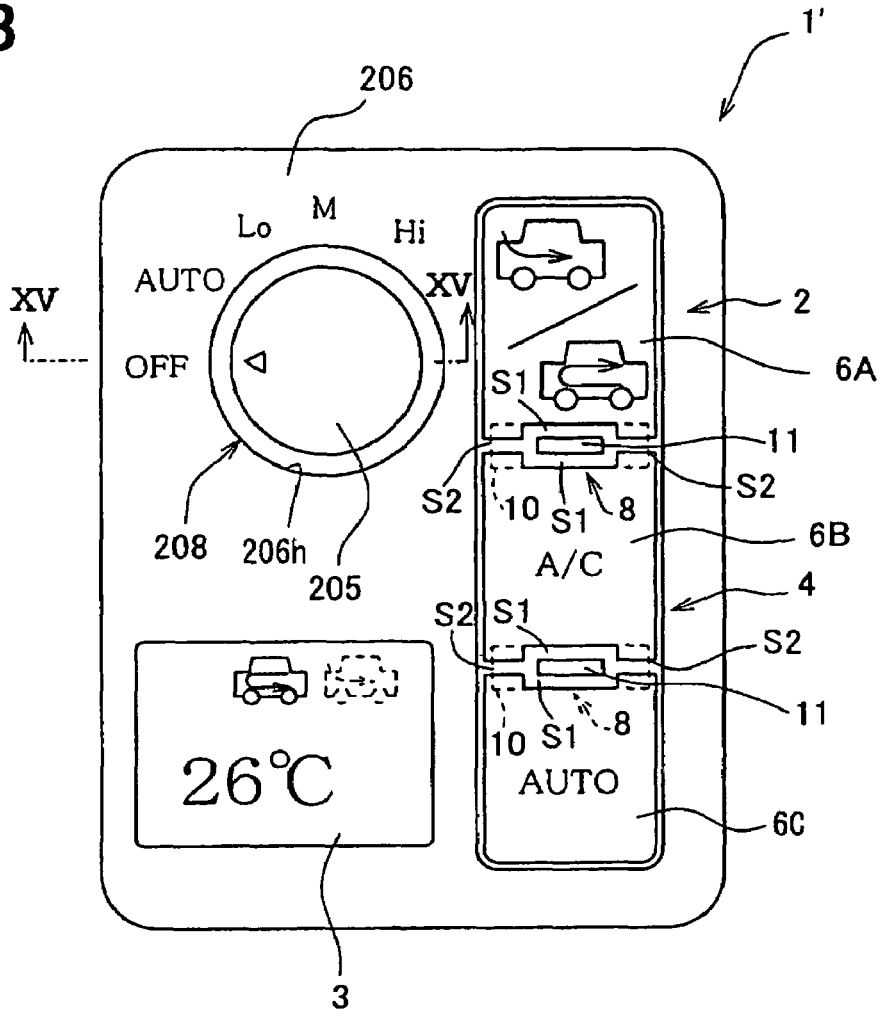
FIG. 13 is a front view showing a switch unit for use in an automotive vehicle, as a second embodiment of the present invention.
Figure 14:
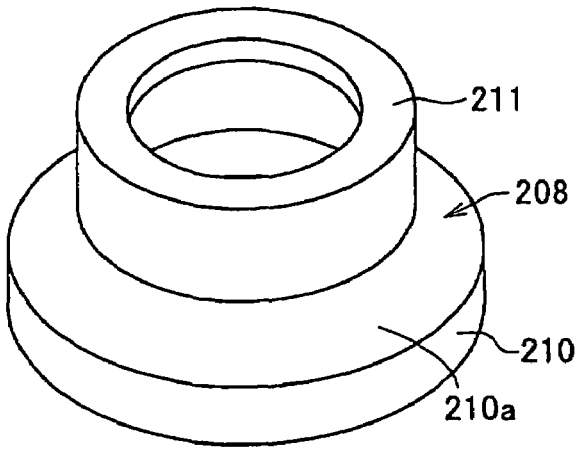
FIG. 14 is a perspective view showing an ornamental member used in the switch unit shown in FIG. 13.

A second embodiment of the present invention will be described with reference to FIGS. 13-15. In this embodiment, the switch panel 1' includes a dial 205 for adjusting air amount. An ornamental member 308 is disposed around the dial 205. As shown in FIG. 14, the ornamental member 208 is composed of a base portion 210 and a cylindrical extending portion 211 extending from the base portion 210. The base portion 210 has a sloped surface 210*a* declining from the foot of the extending portion 211 toward the outer periphery of the base portion 210.

Figure 15:
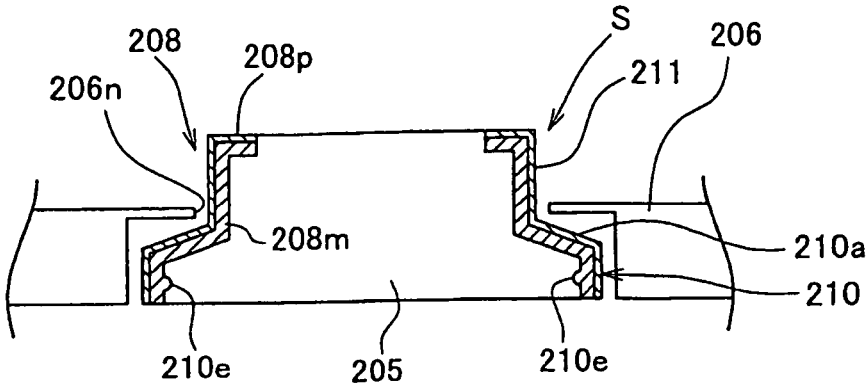
FIG. 15 is a cross-sectional view showing the ornamental member, taken along line XV-XV in FIG. 13.

As shown in FIG. 15, an outer surface of the ornamental member 208 including its sloped surface 210*a* is covered with an ornamental light-reflecting layer 208*p*. The ornamental light-reflecting layer 208*p* is formed on a plastic molded body 208*m*. The dial 205 is inserted into the ornamental member 208 from its bottom opening. A circular projection 210*e* formed on an inner wall of the base portion 210 engages with a groove formed on an outer periphery of the dial 205. A front panel 206 constitutes a neighboring member relative to the ornamental member 208. The front panel 206 has an opening 206*h* from which the ornamental member 208 extends. A circular gap S is formed between the outer periphery of the ornamental member 208 and the opening 206*h* of the front panel 206. Since the light entering through the circular gap S is reflected on the sloped surface 210*a*, the reflected light reaching eyes of the user is suppressed.

Figure 16:
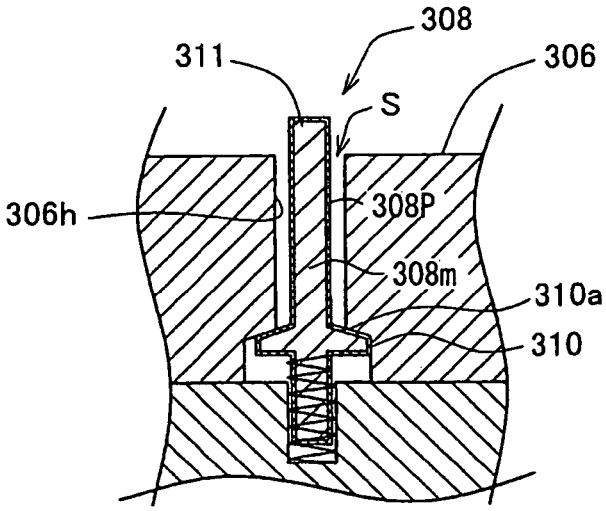
FIG. 16 is a cross-sectional view showing a switch unit as a third embodiment of the present invention.

A third embodiment of the present invention will be described with reference to FIG. 16. In this embodiment, an ornamental member 308 constitutes a push button switch, and a front panel 306 constitutes a neighboring member. The ornamental member 208 is composed of a base portion 310 and an extending portion 311 extending from the base portion

310. A front surface of the base portion 310 is a sloped surface 310*a*. An outer surface of a plastic molded body 308*m* including the sloped surface 310*a* is entirely covered with an ornamental light-reflecting layer 308*p*. The front panel 306 has a hole 306*h* through which the extending portion 311 of the ornamental member 308 extends. A gap S is formed between the extending portion 311 and the hole 306*h*. Since light reaching the sloped surface 310*a* through the gap S is reflected thereon, the reflected light reaching eyes of the user is suppressed.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A switch unit for operating devices mounted on an automotive vehicle, comprising:

an ornamental member having a base portion and an extending portion standing up from the base portion, a front surface of the extending portion being exposed to a front surface of the switch unit; and a neighboring member positioned close to the extending portion, forming a gap therebetween, a front surface of the neighboring member being substantially flush with the front surface of the extending portion, wherein:

a front surface of the base portion and the front surface of the extending portion are covered with an ornamental light-reflecting layer; and the front surface of the base portion is sloped with respect to a surface perpendicular to an extending direction of the extending portion, so that light reaches the front surface of the base portion through the gap between the extending portion and the neighboring member and is reflected on the front surface of the base portion toward an inclined direction with respect to the extending direction of the extending portion.

2. The switch unit as in claim 1, wherein:

the extending portion has a rectangular cross-section having a short side and a long side; and the front surface of the base portion is sloped along the direction parallel to the short side.

3. The switch unit as in claim 1, wherein:

the front surface of the base portion is closer to the front surface of the extending portion at a foot portion of the extending portion than at a fringe of the base portion.

4. The switch unit as in claim 1, wherein:

the extending portion has a rectangular cross-section having a short side and a long side;

the gap includes a first gap formed along the long side of the extending portion; and the front surface of the base portion facing the first gap is sloped.

5. The switch unit as in claim 1, wherein:

the neighboring member is a switch for operating a device mounted on the automotive vehicle.

6. The switch unit as in claim 5, wherein:

the extending portion is located between the switches, forming the gap therebetween; and the base portion serves as a member for mounting the ornamental member to a supporting frame.

7. The switch unit as in claim 6, wherein:

the extending portion has a rectangular cross-section having a short side and a long side;

the gap includes a first gap formed along the long side of the extending portion; and the front surface of the base portion facing the first gap is sloped.

8. The switch unit as in claim 7, wherein:

a depression is formed on a surface of the switch facing the extending portion;

the first gap is formed between the extending portion and the depression; and a second gap is formed between the surfaces of the switches facing each other at longitudinal ends of the extending portion.

9. The switch unit as in claim 8, wherein:

the front surface of the base portion facing the second gap is also sloped.

10. The switch unit as in claim 9, wherein:

the front surface of the base portion facing the first gap forms a first sloped surface, and the front surface of the base portion facing the second gap forms a second sloped surface;

the first sloped surface is extended beyond the first gap into a region of the second sloped surface; and both the first and the second sloped surfaces are declining from a foot of the extending portion toward an outer fringe of the base portion.

11. The switch unit as in claim 10, wherein:

the first sloped surface is formed at both sides of the extending portion along the long side of the extending portion.

* * * * *